US009989296B2

(12) United States Patent
Pavlik

(10) Patent No.: US 9,989,296 B2
(45) Date of Patent: Jun. 5, 2018

(54) SYSTEM FOR REGULATING TEMPERATURE OF WATER WITHIN A FOOD, ICE, BEVERAGE COOLER, OR THE LIKE

(71) Applicant: Seann Pavlik, Fort Lauderdale, FL (US)

(72) Inventor: Seann Pavlik, Fort Lauderdale, FL (US)

( * ) Notice: Subject to any disclaimer, the term of this patent is extended or adjusted under 35 U.S.C. 154(b) by 0 days. days.

(21) Appl. No.: 14/259,932

(22) Filed: Apr. 23, 2014

(65) Prior Publication Data

US 2015/0308728 A1 Oct. 29, 2015

(51) Int. Cl.

| | |
|---|---|
| ***F25D 17/02*** | (2006.01) |
| ***F25D 11/04*** | (2006.01) |
| ***F25D 25/00*** | (2006.01) |
| ***F25D 15/00*** | (2006.01) |
| ***F25D 31/00*** | (2006.01) |

(52) U.S. Cl.

CPC ..... *F25D 15/00* (2013.01); *F25D 17/02* (2013.01); *F25D 31/002* (2013.01)

(58) Field of Classification Search

CPC ..... F25D 11/003; F25D 17/02; F25D 31/006; F25D 31/065; F25D 31/003; F25D 31/002

USPC ..... 62/375, 434, 438, 62, 64, 185, 226, 376

See application file for complete search history.

(56) References Cited

U.S. PATENT DOCUMENTS

| | | | | |
|---|---|---|---|---|
| 626,771 | A * | 6/1899 | Rappleye | 62/376 |
| 2,496,466 | A * | 2/1950 | Graham | 62/201 |
| 2,785,545 | A * | 3/1957 | Pusey | 62/392 |
| 3,888,092 | A * | 6/1975 | Fisher | 62/376 |
| 4,730,463 | A * | 3/1988 | Stanfill | 62/399 |
| 4,754,609 | A * | 7/1988 | Black | 62/59 |
| 4,949,552 | A | 8/1990 | Adams | |
| 4,958,747 | A * | 9/1990 | Sheets | 222/67 |
| 5,743,108 | A | 4/1998 | Cleland | |

(Continued)

FOREIGN PATENT DOCUMENTS

| | | | |
|---|---|---|---|
| WO | WO 9002302 A1 * | 3/1990 | F25D 17/02 |
| WO | WO2007029024 A1 | 3/2007 | |

*Primary Examiner* — Ned Landrum

*Assistant Examiner* — Joseph Trpisovsky

(74) *Attorney, Agent, or Firm* — The Concept Law Group; Scott D. Smiley; Scott M. Garrett

(57) ABSTRACT

A cooling system for containers holding chilled foods and beverages within chilled water, is defined by a thermally insulated cooler or other chilling vessel including a quantity of ice, water, food, and/or beverages, and a safely comestible liquid having a lower freezing point than water mixed in the water, the chilling vessel having an input conduit and an output conduit originating in the vicinity of the chilling vessel. In thermal communication with input and output conduits of the chilling vessel is an endothermic element for removal of heat from a defined ambient geometry about the endothermic element, the ambient geometry forming a part of a liquid loop including liquids within the chilling vessel and the endothermic element. Also included is a thermostat in thermoelectric communication between the chilling vessel output conduit and a compressor within the refrigeration circuit, the thermostat for regulating a power input to the compressor to control a temperature of re-circulated liquids to the chilling vessel to a temperature suitable for comestibles stored within liquids in the chilling vessel.

8 Claims, 6 Drawing Sheets

(56) References Cited

U.S. PATENT DOCUMENTS

| | | | | |
|---|---|---|---|---|
| 5,974,816 | A * | 11/1999 | Endo | 62/179 |
| 6,272,879 | B1 * | 8/2001 | Lopez-Ordaz | 62/318 |
| 6,293,107 | B1 * | 9/2001 | Kitagawa et al. | 62/3.6 |
| 6,474,093 | B1 * | 11/2002 | Fink et al. | 62/434 |
| 6,722,147 | B2 | 4/2004 | Heyl | |
| 7,231,778 | B2 | 6/2007 | Rigney | |

* cited by examiner

SYSTEM FOR REGULATING TEMPERATURE OF WATER WITHIN A FOOD, ICE, BEVERAGE COOLER, OR THE LIKE

BACKGROUND OF THE INVENTION

Area of Invention

The present invention relates to a system, apparatus and method for the liquid cooling of an insulated or uninsulated vessel, such as a cooler, and maintaining foods and beverages therein at a suitable temperature, in which the source of liquid cooling is located externally of the chilling vessel.

Prior Art

A longstanding problem with coolers has been maintaining ice and water therein at a suitable temperature, over a period of time. The contents of the cooler are exposed to the general ambient atmospheric temperature thus, the ice therein will inevitably melt and the temperature of the remaining liquid, typically water, will rise to a level that will cause the food or beverages within the cooler to become unfit for human consumption or cause the food or beverages to lose their desired flavor, this typically occurs at temperatures above 34 degrees Fahrenheit. A parallel problem exists in the case of ice chests and ice tubs of the type typically used in commercial establishments, bars and restaurants, backyard picnics, catered events, theme parks, marine craft, and the like.

Similar problems are prevalent in an industrial context and in governmental and hospital food preparation/serving facilities, and military canteens.

A problem also often presents itself in the transportation of bags of ice to coolers. The mere transportation and maintenance of a sufficient quantity of ice necessary to keep food and beverages at a desired temperature presents various problems including time, labor, and the cost of energy needed to make and keep ice on hand. The present invention can also function as a means of maintaining packaged ice by storing the packaged ice in a special purpose container within the chilling vessel.

Conventional solutions to such issues appear in the art in several forms, however, they amount to nothing more than the incorporation of an evaporative heat exchanger into the chilling vessel or ice chest itself. In such solutions the refrigeration load of the food and beverages within the primary chilling vessel or cooler must be addressed by direct thermal transfer from the evaporator coils. Further, such a solution entails incremental energy and equipment costs that are impractical for backyard, marine, and outdoor venue applications.

The use of endothermic heat exchangers, often termed barrel chillers or evaporators, is known in the art. However, to the knowledge of the inventor, such use has primarily been an integral part of other industries and applications.

Regarding specific prior art, as is known to the inventor, no efforts have been made to employ more than one liquid coolant as part of a refrigerative cooling system which is external to a traditional refrigeration circuit, for the purpose of cooling foods, inclusive of beverages and is in direct contact with the items being cooled. For example, U.S. Pat. No. 4,949,552 (1990) to Adams teaches a cooling system which employs a chiller coil of glycol for the chilling of beverage lines of remotely dispensed beverages. Adams does not reflect the structure or purpose of the inventor's system and method. Adams' system is not intended for cooling packaged food or beverages and the cooling liquid is not in direct contact with the items being cooled. U.S. Pat. No. 5,743,108 (1998) to Cleland teaches a glycol chiller machine in which the glycol is chilled by a heat exchanger and is provided in the immediate proximity to liquid lines at a beverage dispensing location. Therein, glycol operates as the sole heat exchange medium and, as well, the system of Cleland is not applicable to general purpose food and beverage coolers as are typically used in a recreational or bottled beverage context. Cleland's system is not intended for cooling packaged food or beverages and the cooling liquid is not in direct contact with the items being cooled. U.S. Pat. No. 6,722,147 (2004) to Heyl teaches the use of a glycol/refrigerant heat exchanger in a motor vehicle context and, as such, is intended to enhance the operation of the auto's air conditioning and heating systems, given the low specific heat of glycol relative to water. The use of a glycol/refrigerant heat exchanger is thus able to enhance the efficiency of both the cooling and heating functions within a car. U.S. Pat. No. 7,231,778 (2007) to Rigney teaches a cooling system for a commercial aircraft galley and thereby addresses a persistent problem in catering upon aircraft, namely, that of providing sufficient thermal values, whether heating or cooling in character, to the serving cart on the aircraft which, after a period of time, tends to approach the ambient temperature of the passenger compartment in the absence of a continual input of thermal values at a desired temperature and the liquid is not in direct contact with the beverages. Rigney's system is intended for cooling packaged food or beverages but the cooling fluid is not in direct contact with the items being cooled.

PCT Publication WO 2007029074 to Guadalupi teaches a cooling system for beverages in which glycol is maintained as a separate heat exchange fluid from water and functions as a means by which the water may be maintained at a desired temperature by negative thermal values from a discrete glycol circuit. Guadalupi's system is not intended for cooling packaged food or beverages and the cooling fluid is not in direct contact with the items being cooled.

The present invention thereby provides an improvement in both function and efficiency over the art in the area of coolers, chilling vessels, food coolers, and combinations thereof.

SUMMARY OF THE INVENTION

The invention relates to the use of an endothermic heat exchanger as the evaporation component of an otherwise conventional refrigeration circuit. Through the use of an endothermic heat exchanger, or barrel chiller, as the evaporator element of the refrigeration circuit, an input conduit of water from a chilling vessel, cooler, ice tub, or like vessel may be provided to supply to the endothermic heat exchanger, external to its evaporative coils by which the primary function of the barrel chiller of withdrawing heat is accomplished. The volume of water in the chilling vessel is generally equal to or greater than the volume of the geometry of the barrel chiller. A thermostat may be used to control the compressor on the refrigeration circuit by which thermal work of the evaporator is performed. Therein, the temperature of the liquid within the chilling vessel and input of the barrel chiller is continually monitored and adjusted, i.e., the endothermic function of the evaporator coils of the barrel chiller are controlled such that the liquid outlet thereof, external of its coils, provides a liquid input to the chilling vessel at a temperature sufficient to maintain the food and beverages therein at a temperature that is safe for consumption and optimal in taste. The liquid in the geometry of the barrel chiller employs a minimum of energy within the refrigeration circuit particularly, if added to the primary liquid (typically water), is a quantity of glycol or other such FDA approved consumable liquid having a specific heat lower than that of water. As a result, a liquid output of the endothermic heat exchanger or barrel chiller can be maintained at a temperature under the freezing point of water or, if desired, at a temperature slightly thereabove, for reduced consumption of energy. In a preferred embodiment, the system is standalone, occupies only a few cubic feet and may be located beneath or otherwise in close proximity to the chilling vessel. An appropriate circulation pump assures a sufficient liquid flow within the circuit about the evaporator coils in the endothermic heat exchanger, and flow of water through the chilling vessel at a sufficient velocity to assure that liquid therein will not freeze even if its temperature is less than that of the freezing point of water.

Substantially the same effect as glycol may be accomplished by increasing the flow inside the barrel chiller so that circulating water, with or without glycol, may be chilled to a sub-freezing temperature within the barrel chiller and then circulated to the chilling vessel.

Other embodiments are also set forth herein.

It is accordingly an object of the present invention to provide an improvement to a cooler, ice tub, or like vessel of any size, in which water and/or other liquids within the chilling vessel can preserve packaged foods and beverages stored therewith, while the temperature in the chilling vessel is maintained without the use of ice over its period of use.

It is another object to provide an improved method for cooling a vessel of the above type having application in commercial establishments, bars and restaurants, backyard picnics, catered events, theme parks, marine craft, and the like. A further object is to provide a system and method of the above type by which the contents of the chilling vessel may, if desired, be cooled to temperatures below that of atmospheric freezing without concern that the water or other liquid therein may itself freeze.

It is another object to provide a system and method of the above type in which the chilling of the liquid and comestible contents of a chilling vessel may be maintained at a desired temperature at a lesser energy cost than that of incorporating evaporative elements of a conventional ice machine into the chilling vessel itself.

A further object is to provide a system of the above type that provides general ease of cleaning and/or maintenance of the system. An antibacterial solution can be introduced into the water flow and circulated, allowing for effective sanitizing of the chilling vessel. Larger chilling vessel systems, such as the type used in bars and restaurants, can be set automatically to clean at any time, drain, and refill themselves eliminating man power and downtime used to clean the chilling vessel. A UV light cartridge can also be installed in the return lines to remove bacteria from the water on a continuing basis, making the chilling vessel more hygienic and safer than ice machines, ice tubs, and prior art coolers.

The above and further objects include the provision of a system having a volume suitable for commercial use, marine, medical and various military uses, where the maintenance of a fluid, solids, or other materials at a given low temperature, at ambient atmospheric pressure, is a system requirement.

The above and yet other objects and advantages of the present invention will became apparent from the hereinafter set forth Brief Description of the Drawings, Detailed Description of the Invention, and Claims appended herewith.

DETAILED DESCRIPTION OF THE INVENTION

Figure 1:
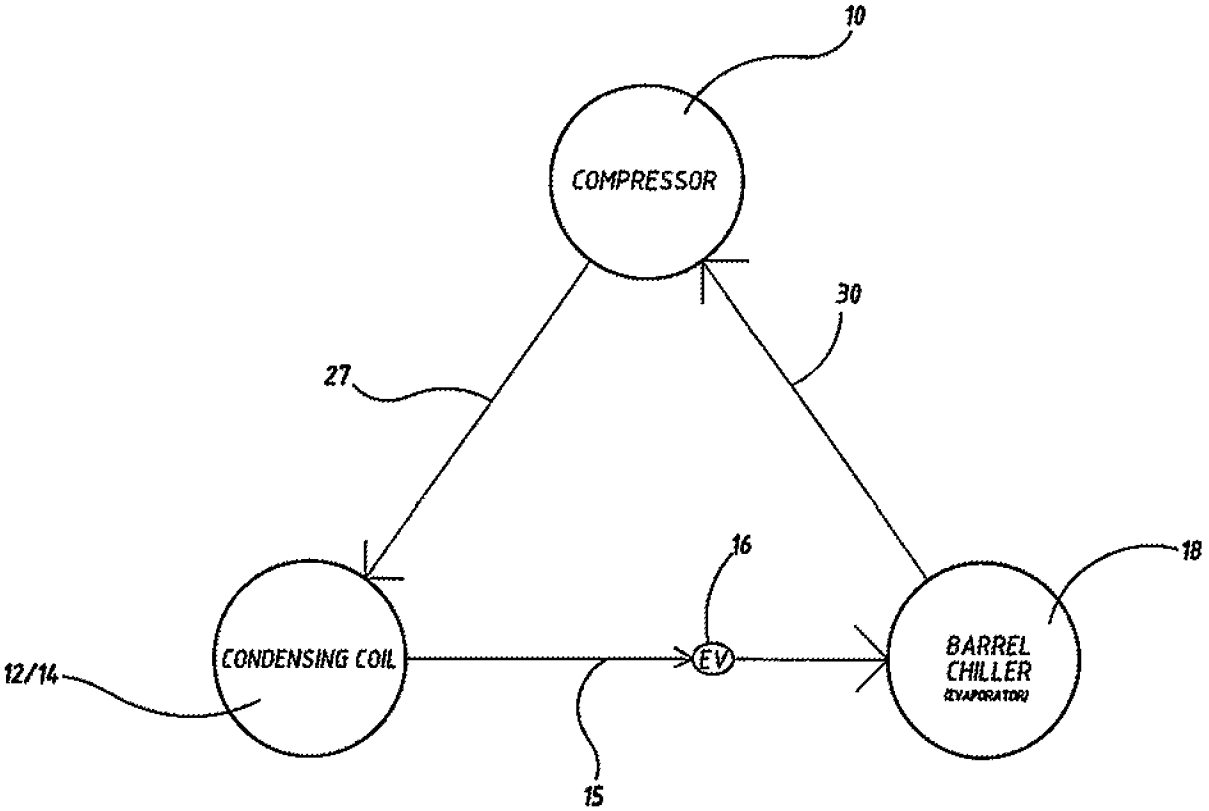
FIG. 1 is a conceptual view illustrating the general principles of a refrigeration circuit.

With reference to FIG. 1, there is shown a conceptual view of a refrigeration circuit. Therein is shown a compressor 10 which, on the high pressure side of the circuit is shown condenser 12 which typically takes the form of a condensing coil 14 and associated fan (see FIG. 2). From condenser 12, a liquefied refrigerant 15 proceeds to expansion valve (EV) 16 to an evaporator 18 which, in a preferred embodiment, takes the form of a barrel chiller. A barrel chiller is an endothermic heat exchanger which is offered by various vendors inclusive of RK2 Systems, Pentair, Aqua Logic, and Standard Refrigeration. It is however to be understood that other forms of heat exchangers may be employed as equivalents of a barrel chiller. From barrel chiller 18 a refrigerant line 30 supplies compressor 10 with refrigerant.

Figure 2:
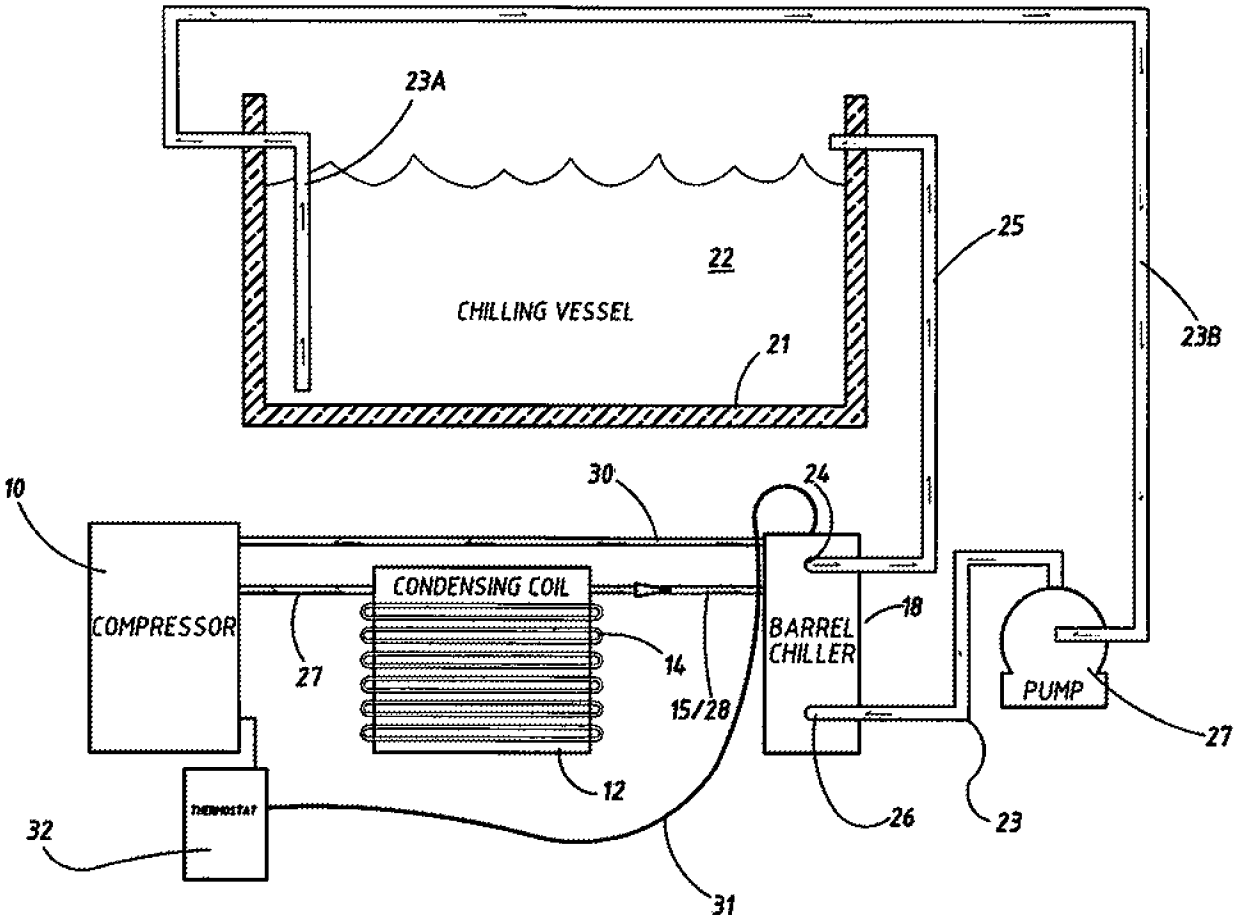
FIG. 2 is a flow diagrammatic view of the invention and its liquid and refrigeration circuits. This represents a standalone unit, requiring only a power input to the compressor.
Figure 3:
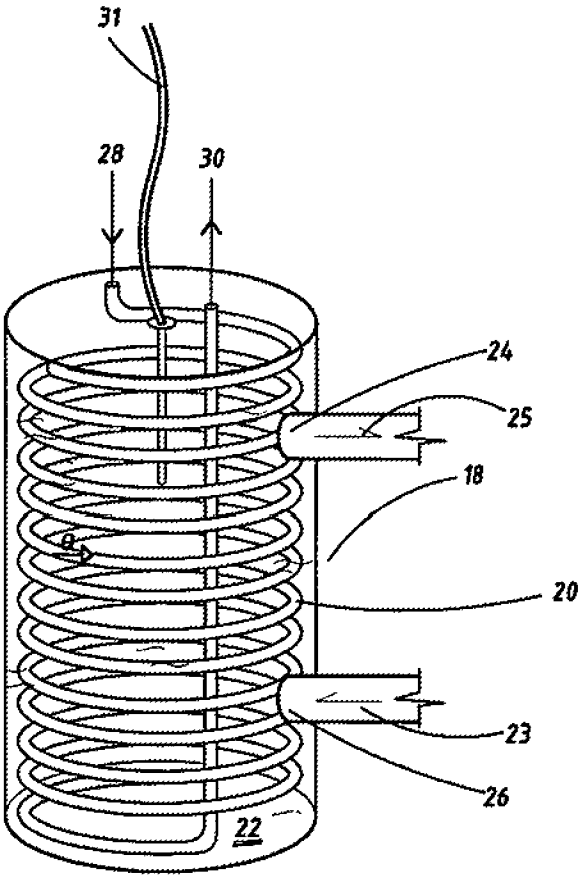
FIG. 3 is a conceptual schematic view of the interior portions of an endothermic heat exchanger such as a barrel chiller suitable for use in the present system.

A representative barrel chiller is shown schematically in FIG. 3. As may be noted, the barrel chiller contains a plurality of internal coils 20 which may be spiral or essentially flat and within which is low pressure, low temperature refrigerant, causing an absorption of heat Q (shown schematically in FIG. 3) from circulated water or liquid. That is, barrel chiller 18, filled with low temperature coils 20, will absorb heat Q from liquid or water 22. The liquid is typically provided to barrel chiller 18 from liquid input 26. (See FIG. 2). Liquid 22 then exits chiller 18 at output 24 to transport liquid 22 to a cooler 21 via conduit 25 to locations where chilled water or liquid is required to maintain a desired temperature of food or beverages in chilling vessel 21. Also shown in FIG. 1-3 is a typical location of a refrigerant outlet 30 between barrel chiller 18 and compressor 10.

In regard to FIG. 2, the present system and method preferably employ a mixture of glycol and water as the liquid chilling medium within a re-circulating liquid circuit including insulated cooler 21, output conduits 23A/23B, pump 27, conduit 23 though chiller inlet 26, to the interior of the barrel chiller 18 but external to coils 20, and cooler input conduit 25 from chiller outlet 24. Thereby, liquid 22 may be maintained at temperatures well below freezing, such as 28 degrees Fahrenheit because of the lower specific heat of glycol relative to water. That is, glycol is able to absorb more heat per unit volume than can water and, by the same token, it is capable of expelling more heat per unit volume to the cooling coils 20 within the geometry of the barrel chiller as shown in FIG. 3. A result of the addition of an FDA approved liquid such as glycol or ethanol is that barrel chiller 18 is able to cool the chilling liquid 22 of the open loop liquid circuit as above-described, to temperatures below freezing which otherwise would not be possible in a cooler vessel without high water flow, regardless of how efficiently refrigerated, since liquid water can never fall to a temperature below 32 degrees F. at atmospheric pressure.

A particular advantage of the present system is that the need to keep extra ice that often occurs at picnics and outdoor events, as well as on marine craft, is completely eliminated since an endless supply of liquid at, near, or below freezing is herein provided. Certain foods and beverages are tastier at temperatures slightly above freezing, (e.g., are optimal in flavor at about 34 degrees F. for beer). However, sufficient melting of ice in an insulated ice cooler presents a constant issue, as does ambient temperature when the covering of the cooler is open, that inevitably will cause enough ice to melt to cause the temperature of beer, soda, foods, and other temperature-sensitive comestibles to either lose their flavor or become completely unsafe for human consumption. Accordingly, through use of the present invention, as above described, the need to continually re-fill insulated ice-holding coolers with ice is completely obviated. Further, if one wishes to preserve the solid condition of ice, one may place smaller containers of ice within a larger insulated chilling vessel of the type above-described to prevent ice or ice cubes within such containers from melting as quickly. At many social events, mixed drinks are served which require conventional ice cubes. Accordingly, by confining such ice cubes to a sub-container within a larger chilling vessel, one can assure that ice will never be wasted through unwanted melting thereof.

It should be appreciated that the input and output conduits 26 and 24 respectively may readily be reversed in a given configuration of a barrel chiller. For example, the barrel chiller may be inverted relative to the position shown in FIGS. 2 and 3 and, as well, can function in a horizontal orientation. Similarly, a supplemental pump, similar to pump 27, may be added to the input line 25 of the chilling vessel 21.

It is also noted that the use of glycol may be eliminated by increasing the flow of the interior of the outer geometry of the endothermic heat exchanger or barrel chiller 18 external of the internal coils 20. See FIG. 3. This will alter the thermodynamics of the barrel chiller such that the coils within the chiller can absorb enough heat from the water to hyper-chill the water while still in a liquid state, that is, without freezing. Thereafter, hyper-chilled water is pumped through outlet 24 into conduit 25 and then into chilling vessel 21, substantially chilling water 22 in the chilling vessel, although crystals of ice may form as the hyper-chilled water is exposed to atmospheric pressure.

Figure 4:
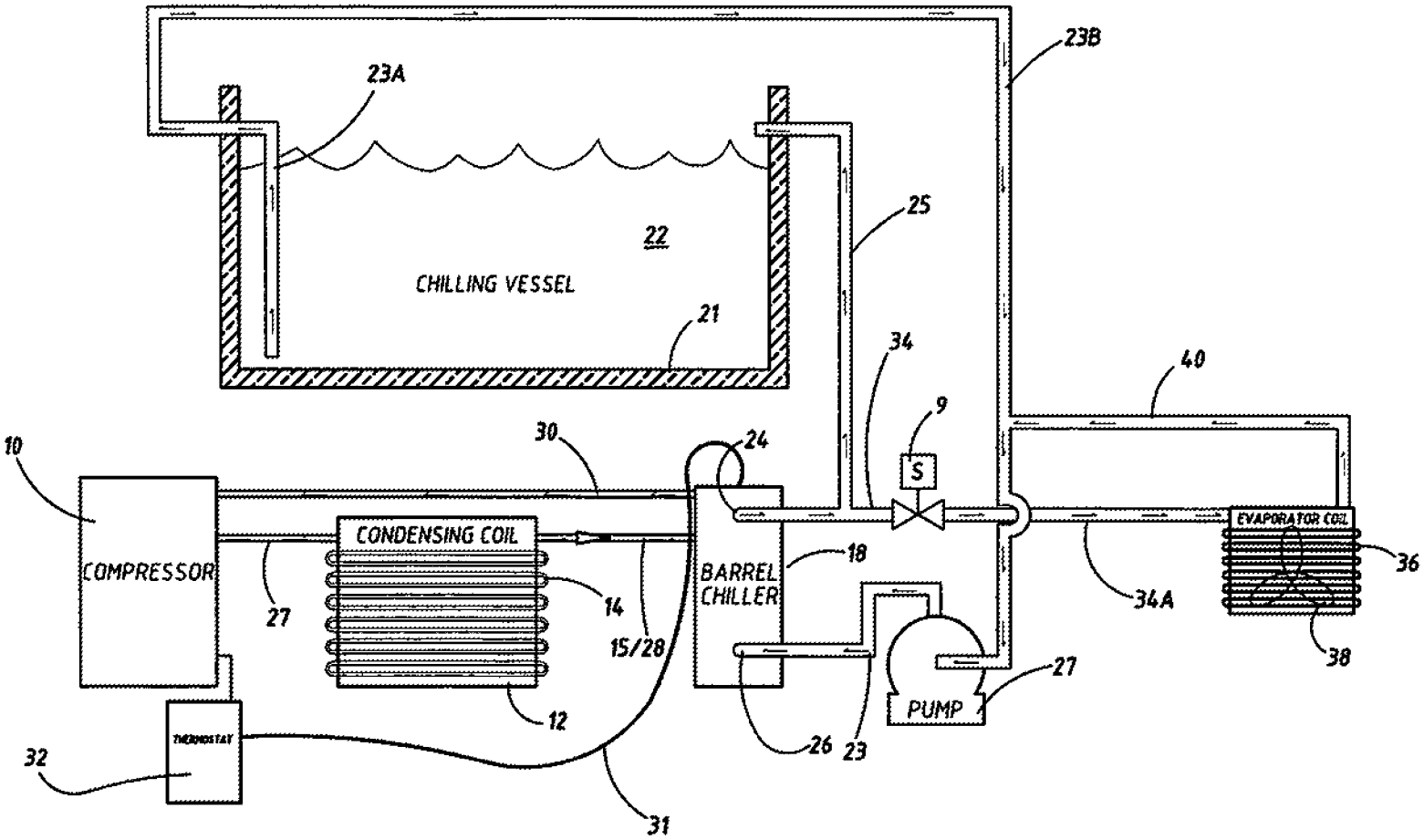
FIG. 4 is a flow diagrammatic view of an embodiment of the invention which provides an air cooling capability to the system

In FIG. 4 is shown a further embodiment of the invention. Therein, input conduit 25 to the chilling vessel 21 splits into a further liquid line 34 and therefrom, following solenoid 9, to liquid line 34A and into thermal contact about external evaporator 36 and fan 38 which draws air from the local ambient air and removes heat therefrom. Air is cooled, then re-introduced through a small duct, cooling the immediate surrounding area and providing a significant cooling capability. Liquid output 40 is then connected to cooler output line 23B which, through pump 27, is then re-introduced into barrel chiller by line 23A.

Figure 5:
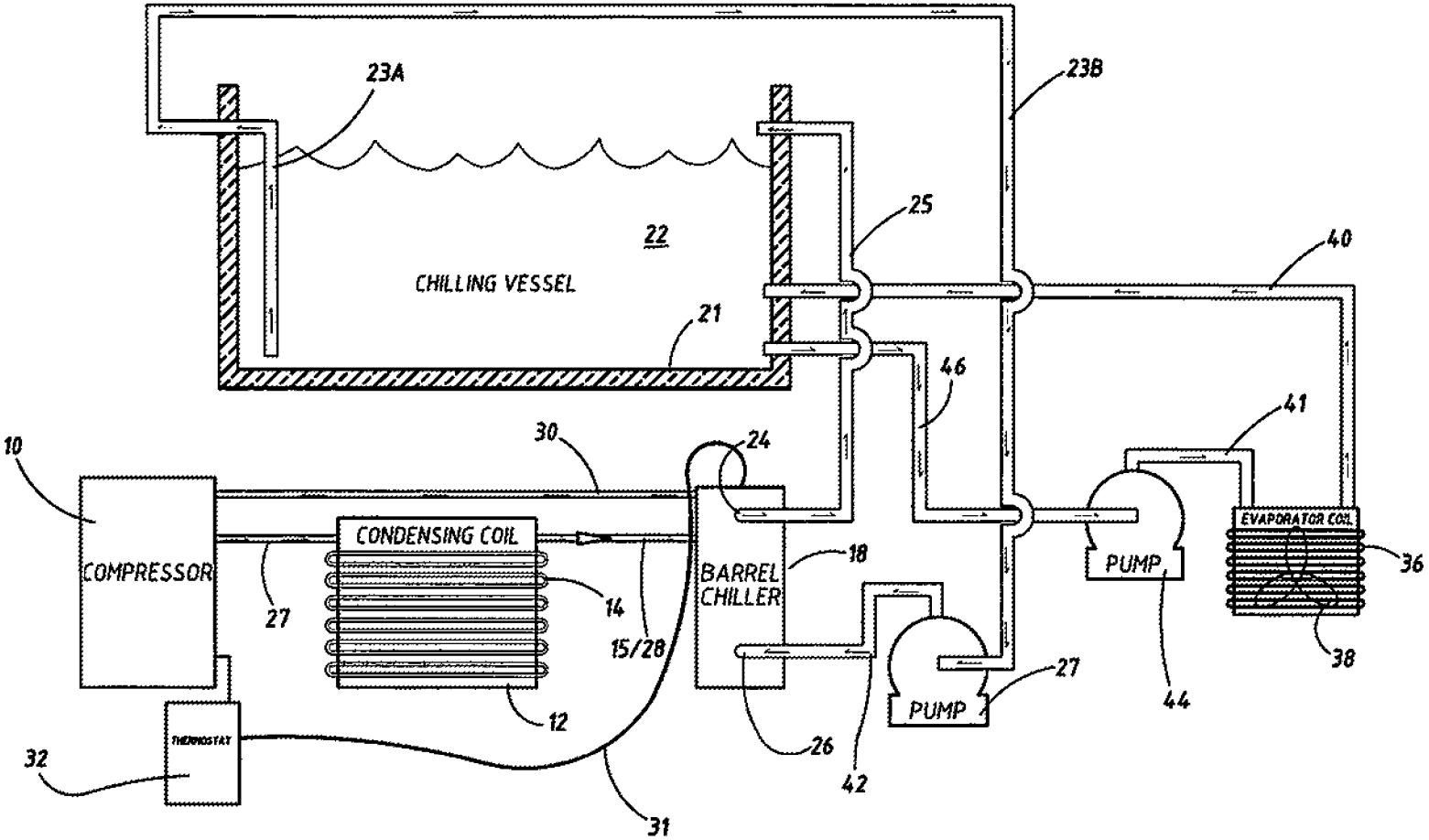
FIG. 5 is a flow diagrammatic view of a variation of the embodiment of FIG. 4.

In FIG. 5 is shown a variation of the embodiment of FIG. 4 in which there is provided a second pump 44 which powers a second water loop through conduit 46 from water 22 in vessel 21, to said pump 44, via conduit 41 through evaporator 36, and output line 40 back to vessel 21. By this method enhanced chilling may be provided to water 22 in vessel 21, as well as the benefit of external cooling by evaporator 36.

Figure 6:
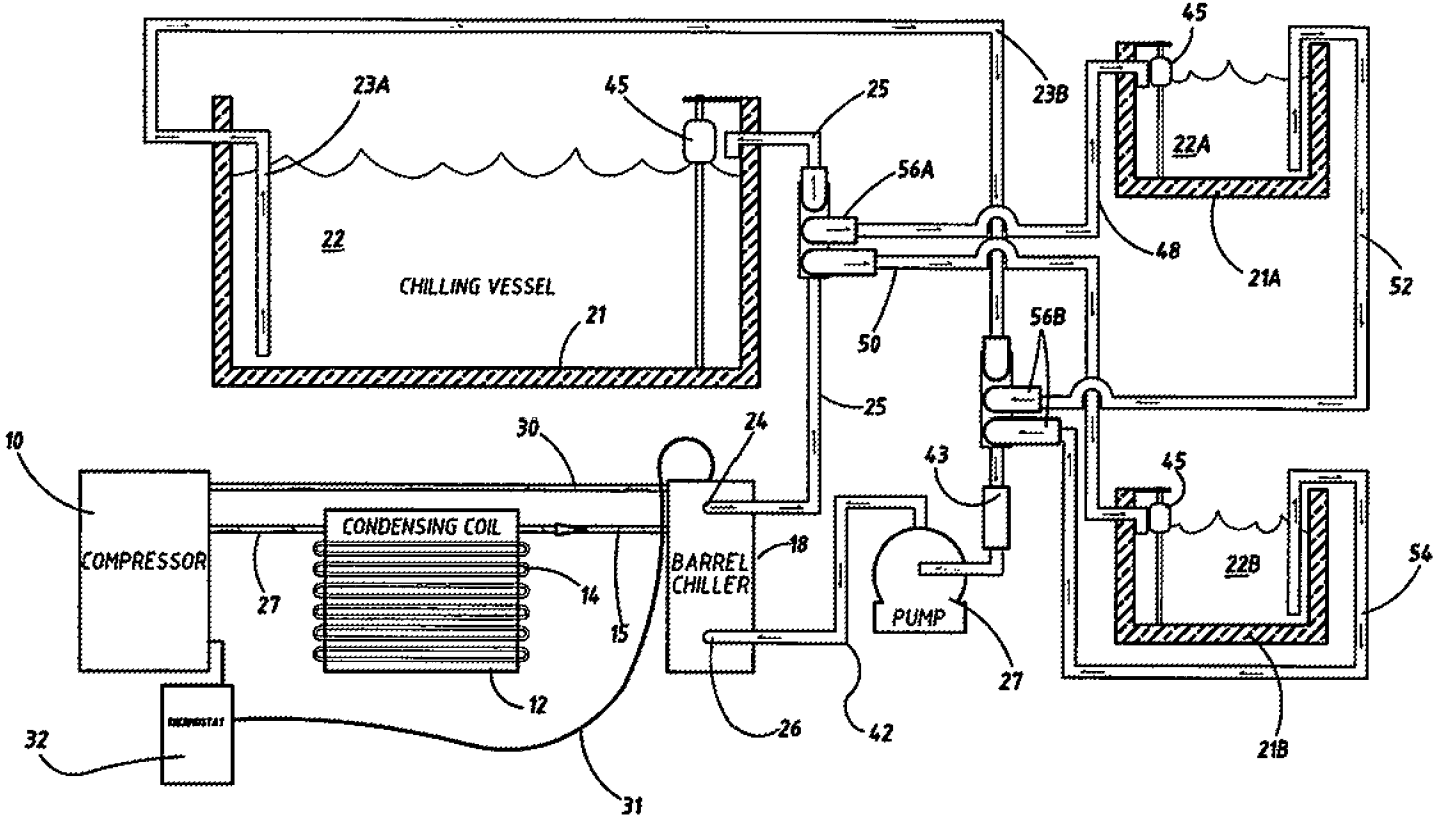
FIG. 6 is a flow diagrammatic view of a multiple chilling vessel embodiment of the system of FIG. 2.

In FIG. 6 is shown an embodiment of the system of FIG. 2 adapted for commercial use in which multiple chilling vessels 21A and 21B are employed. As may be seen, this embodiment functions off of liquid lines 48 and 50 of the basic system off of line 25, which supplies vessels 21A and 21B with water 22A and 22B respectively. Outputs from vessels 21A and 21B are accomplished through lines 52 and 54 and, through manifolds 56A and 56B, return to vessel output line 23B, through an anti-germicidal cartridge 43 and to pump 27 which supplies water through line 42 to barrel chiller 18. The function of input line 25 remains unchanged from prior embodiments.

Also shown in FIG. 6 is float 45 by which the level of water 22, 22A and 22B in vessels 21, 21A, and 21B may be monitored and maintained by control of input lines 25, 48 and 50 by the use of solenoid 9. (See FIG. 4.) Such a float may be employed in all embodiments of the invention.

While there has been shown and described above the preferred embodiment of the instant invention it is to be appreciated that the invention may be embodied otherwise than is herein and that, within said embodiment, certain changes may be made in the form and arrangement of the parts without departing from the underlying ideas or principles of this invention as set forth in the Claims appended herewith.

I claim:

1. A system for chilling beverages disposed within a container having a liquid disposed therein, said liquid in direct contact with said beverages, said system comprising:

(a) a refrigeration circuit including an evaporator defining an internal volume, one or more coils of the refrigeration circuit disposed within said internal volume of said evaporator,said volume pressurized, said evaporator having a fluid-tight inlet and a fluid-tight outlet in communication with said internal volume of said evaporator, external to said one or more coils;

(b) a first liquid conduit having a first end and a second end, the first end of the first liquid conduit in communication with said pressured internal volume of the evaporator, the second end of the first liquid conduit adapted for positioning with respect to said container positioned physically remotely from said evaporator, liquid entering the first liquid conduit from the evaporator flowing out of the second end of the first liquid conduit and into a liquid storage region of said container, said second end delivering reduced temperature liquid from the evaporator external of said one or more coils to the container such that the reduced temperature liquid is in fluid communication with and continuously available for chilling a plurality of beverages that are disposed in the liquid storage region of the container, said liquid entering said first conduit defining a volume substantially equal to said internal volume of the evaporator external to said one or more coils; and (c) a liquid return line for returning liquid disposed within the liquid storage region to the evaporator, said liquid return line including a second liquid conduit having a first end and a second end, the first end of the second liquid conduit positioned within the liquid storage region of the container closer to a bottom of the liquid storage area than to a top of the liquid storage region;

wherein said second end of said first liquid conduit positioned with respect to the storage region of a container to permit the reduced temperature liquid traveling through the first liquid conduit to the liquid storage area of the container above a current liquid surface level of the liquid already disposed within the liquid storage region.

2. The system as recited in claim 1, in which said liquid further comprises:

a lower-than-water freezing point comestible liquid including a glycol.

3. The system as recited in claim 1, further comprising:

a liquid pump within a liquid loop defined by the first liquid conduit and said return line to enhance recirculation of said liquid within said liquid loop.

4. The system as recited in claim 1, in which said liquid return line comprises a selectable segment.

5. The system for chilling beverages of claim 1, wherein the first end of the second liquid conduit is positioned within the liquid storage region of the container and submerged under a surface of the liquid disposed within the liquid storage region.

6. The system for chilling foods or beverages of claim 5, wherein said evaporator is mechanically independent of the container, the evaporator neither contacting the container and the evaporator nor secured to the container.

7. The system of claim 1, further comprising:

a float disposed within the container, said float for monitoring and maintaining an amount of liquid disposed within the container through control of liquid flowing through the first liquid conduit.

8. The system for chilling beverages of claim 1 wherein said liquid return line further comprises:

a pump;

the second end of the second liquid conduit in fluid communication with the pump; and a third conduit having a first end and a second end, the first end of the third liquid conduit in communication with the pump and the second end of the third conduit secured to the liquid inlet of the evaporator, the third conduit in liquid communication with the internal volume of the evaporator, delivering the liquid returning from the liquid storage region of the container back to the internal volume of the evaporator, external of said ones or more coils.

* * * * *